United States Patent [19]

Fitch et al.

[11] 4,129,495

[45] Dec. 12, 1978

[54] SUPPORT STRUCTURE FOR PLURAL CELL ELECTROLYZER

[75] Inventors: Robert H. Fitch, Syracuse; Bruce E. Kurtz; Bronislaw B. Smura, both of Marcellus, all of N.Y.

[73] Assignee: Allied Chemical Corporation, Morris Township, Morris County, N.J.

[21] Appl. No.: 866,157

[22] Filed: Dec. 30, 1977

[51] Int. Cl.[2] ..... C25B 1/16; C25B 1/26; C25B 9/00

[52] U.S. Cl. ..... 204/279; 204/252; 204/253; 204/254; 204/268

[58] Field of Search ..... 204/252, 253, 254, 255, 204/267, 268, 269, 270, 279, 297 R

[56] References Cited

U.S. PATENT DOCUMENTS

| | | | |
|---|---|---|---|
| 3,335,079 | 8/1967 | Nellen | 204/279 X |
| 3,875,040 | 4/1975 | Pomiczinski | 204/254 X |
| 3,898,149 | 8/1975 | Kircher et al. | 204/252 |
| 3,926,770 | 12/1975 | Hoekje | 204/255 X |
| 4,028,208 | 6/1977 | Giacopelli | 204/252 |
| 4,060,474 | 11/1977 | Masure et al. | 204/252 X |
| 4,064,032 | 12/1977 | Bouy et al. | 204/268 X |

*Primary Examiner*—Arthur C. Prescott
*Attorney, Agent, or Firm*—Anthony J. Stewart

[57] ABSTRACT

A retaining and restraining support structure for a plural cell electrolyzer is comprised of a sleeper assembly for supporting the electrolyzer cell along its longitudinal dimension, and a tension bar assembly for maintaining each of the cells in a substantially vertical plane, while insuring good mechanical connection and fluid communication therebetween, wherein the tension bar assembly includes plural longitudinal, adjustable tension bars and diagonal, adjustable tie bars.

7 Claims, 7 Drawing Figures

SUPPORT STRUCTURE FOR PLURAL CELL ELECTROLYZER

BACKGROUND OF THE INVENTION

1. Field of the Invention

The present invention relates to a retaining and restraining structure for plural cell electrolyzers. More specifically, the present invention relates to a supporting structure including a plurality of longitudinal tension bar assemblies for retaining the cells of a plural cell electrolyzer in face-to-face orientation, and diagonal adjustable tie bars for restraining the electrolyzer cells in a vertical orientation.

2. Description of the Prior Art

The electrolysis of various fluid media is well known, and widespread. For example, the electrolysis of sodium chloride brine is by far the most important commercial process for producing chlorine and caustic soda, which electrolysis products are extensively employed in numerous other applications. Recently, there has been a tremendous interest in electrolysis cells incorporating permselective membranes which restrict gross hydraulic flow between compartments in such an electrolyzer. Because the membranes, typically cationic permselective membranes of a perfluorinated organic polymer matrix having ionogenic sulfonate groups attached thereto, preclude the flow of liquid while permitting, e.g., current-carrying sodium ions to pass, it is now possible to produce caustic soda of a predetermined concentration and nearly free from chlorides.

To obtain maximum utility from these cells incorporating permselective membranes, a multi-cell electrolyzer is conventionally employed. In this plural cell design, a number of semi-independent cells are arranged in serial fashion and provided with various means for permitting flow of the fluid medium to be electrolyzed, and means for electrical communication between and among the various cells comprising the electrolyzer. While such a design takes full advantage of the characteristics of the permselective membranes, precautions must be taken to prohibit fluid and/or gaseous leakage at, for example, points of mechanical connection of the cell components since, obviously, the advantage of the membrane characteristics would otherwise be lost. Thus, the art recognizes the need to provide reliable retaining and restraining structures to achieve a twofold purpose. Broadly speaking, the individual cell frame members must be maintained in a fluid-tight intimate, face-to-face contact; and, the individual cells should be maintained in a substantially vertical plane.

To this end, there are various known retaining structures such as those exemplified in U.S. Pat. Nos. 3,875,040; 3,926,770; and 4,017,375. Typically, the support or restraining structures include a number of longitudinal tension bars or the like which are affixed to end frame members at the terminal ends of the electrolyzer. This arrangement allows for the exertion of a retaining compressive force on each of the cells comprising the electrolyzer. Vertical stability is achieved by rigid terminal frame members. Other arrangements suitable for these purposes are disclosed in U.S. Pat. Nos. 1,094,728; 1,535,185; and 2,881,123.

While generally efficacious for their intended purposes, the prior art support devices fail to fully account for ease of support and stability, and optimum serviceability. For example, in the event a cell or stage within the electrolyzer requires replacement, access is severely limited due to the large, rigid, and often cumbersome retaining and restraining devices based upon rail supports and hydraulically or mechanically actuated platens. Accordingly, the need exists to provide a support structure which insures all of the advantages of prior art assemblies, but which is materially simpler in design and which further allows ready access to the internal cells of an electrolyzer.

SUMMARY OF THE INVENTION

In accordance with the noted deficiencies of the prior art, it is a primary object of the present invention to provide a support structure for retaining and restraining the individual cells of a plural cell electrolyzer which insures positive face-to-face contact between individual cells and also a substantially vertical orientation of individual cell frames.

Another object of the present invention is to provide a support for plural cell electrolyzers which is materially simpler than prior art supports but which offers all of the advantages thereof.

Yet another object of the present invention is to provide a simple, yet highly efficient, cell support for a plural cell electrolyzer which allows easy access to internal components.

It has now been determined in accordance with the present invention that the foregoing, and other objects and advantages, may be realized by providing an electrolyzer cell, comprised of a plurality of individual cells disposed in serial relationship, with a sleeper assembly for supporting the same, a tension bar assembly for retaining the individual cells in a compressive, positive, intimate relationship, and a tie bar assembly for restraining the cells in a substantially vertical plane. The sleeper assembly is, most preferably, comprised of a pair of longitudinal members inserted beneath the electrolyzer cell; which not only support the cell but also space it vertically from a substantially horizontal support (for example, a concrete floor). The tension bar assembly includes a number of longitudinal, adjustable tension bars which extend between the terminal end frame members of the electrolyzer cell, and which may be adjusted to compressively retain the individual cell members. The tie bar assembly includes adjustable diagonal tie bars attached to one end to the top of an end frame member and at the other end to horizontal extensions of the sleeper assemblies, or a horizontally displaced anchor point. These diagonal tie bars provide means for establishing a restraining force on the electrolyzer, thus insuring a substantially vertical orientation of each of the cell members.

Various other objects and advantages of the present invention will become apparent upon examination of the following detailed description of the invention, taken in conjunction with the Figures of Drawing, wherein:

BRIEF DESCRIPTION OF THE DRAWINGS

FIG. 6 is an enlarged fragmentary vertical sectional view, through the brine feeder header connection, taken substantially along the line 6—6 of FIG. 2; and, FIG. 7 is a horizontal sectional view through the fitting of the brine feeder header connection, taken substantially along the line 7—7 of FIG. 6.

DETAILED DESCRIPTION OF THE INVENTION

The present invention relates, generally, to support structures for plural cell electrolyzers comprised of individual cell units. Each cell itself comprises a pair of electrodes separated by a, preferably, permselective membrane. The individual cell members are positioned, in face-to-face relationship, to constitute the electrolyzer cell. Means are provided for electrical communication between the cells, as well as for fluid and gaseous feed and recovery.

Two structural aspects for successful operation of a plural cell electrolyzer are essential. First, the individual cell members must be accurately positioned and retained relative to one another to preclude unwanted leakage of fluid and/or gas. Second, the overall electrolyzer should be maintained in a balanced configuration by insuring a substantially vertical disposition of each cell member. It is to these spatial considerations that the present invention is explicitly addressed.

Furthermore, the design of the support structure of the present invention is one developed with an eye toward the elimination of much of the cumbersome and expensive hardware of similar prior art devices. For example, as compared with the conventional side rail supports and hydraulically or mechanically actuated platens to compress the cell frames and membranes together, the present invention employs merely a plurality of retaining elements of, e.g., tension bars, and a simplified restraining structure comprised of, e.g., a pair of diagonal tie bar assemblies. Thus, it is now possible to eliminate the side rails and ears or hangers from the cell frames, which structures are essential to prior art supporting apparatus. An additional advantage resides in the ease with which access to internal cell frames may be accomplished.

In order to more fully elucidate upon the various objects and advantages of the present invention, the following detailed description will be given in terms of certain preferred embodiments thereof. However, the same are intended as illustrative only, and not limitative.

Figure 4:
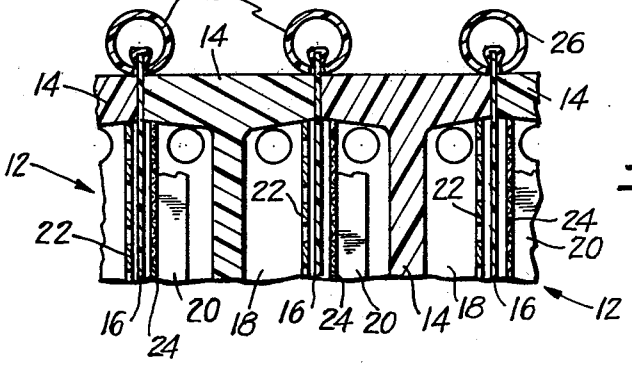
FIG. 4 is an enlarged, fragmentary vertical sectional view through a group of adjacent cells comprising the electrolyzer, taken substantially along the line 4—4 of FIG. 1.

The electrolyzer of the present invention, designated generally as 10, is comprised of a plurality of individual cells 12 best viewed in, for example, FIG. 4. As the present invention is disclosed in terms of bipolar permselective membrane electrolyzers, the individual cells 12 are separated by cell frame center webs 14. Each cell, as is conventional, is comprised of a membrane 16 dividing the cell into an anode compartment 18 and a cathode compartment 20. Thus, on opposing sides of the membrane 16, there is an anode electrode 22 and a cathode electrode 24. Membrane securing members 26 position the membrane 16 within the cell 12, and permit withdrawal of the membrane for, e.g., replacement or disassembly of the electrolyzer. Mechanical connection and electrical communication between cells is made by way of a plurality of intercell connectors 28, while external electrical connection is made via end cell fittings 29.

Fluid communication both to individual cells and between adjacent cells must be carefully controlled, and appropriately restricted. For example, since a primary advantage of utilizing permselective membranes regards the ability of such membranes to selectively pass constituents of the fluid being subjected to electrolysis while precluding hydraulic flow between compartments, it is obviously essential that the structure incorporated not contribute to or allow such unwanted fluid communication. It is also essential that fluid to be subjected to electrolysis be appropriately routed to the cells and spent fluid be removed therefrom. A particular advantage of the support structure of the present invention regards this proper fluid communication to and through the cells.

Feed brine is supplied to the electrolyzer 10 through a header 30, while communication to each cell 12 is provided via feed brine hoses 32 which admit brine to the lower portion of each cell through fittings 34. Feed water is introduced to the electrolyzer by means of a feed water header 36, while communication with individual cells is similarly achieved by means of a plurality of feed water hoses 38 which introduce water to the lower portion of the cells via fittings 40. Caustic soda and hydrogen resultant from the electrolysis of the brine material is routed from the electrolyzer via a caustic soda/hydrogen header 42. The header 42 is fed by individual cells through fittings 44 at the upper portion of each cell and through conduits 46. In a similar fashion, spent brine resultant from electrolysis is routed from the electrolyzer via a header 48 which is fed by individual cells through fittings 50 and conduits 52.

The various conduits, hoses, and the like should be fabricated from a material which is chemically resistant to the electrolysis environment. Advantageously, natural rubber or similar elastomeric materials will be employed, although the selection of other appropriate materials is well within the skill of the art.

To appropriately regulate the feed of brine fluid, while precluding the leakage of electrical current through the feed brine system, a metering device, designated generally as 60 in FIG. 6, is employed. The metering device 60 is conveniently attached to header 30, by means of a threaded fitting 62, at each point along the header where the feed brine hoses attach, and each hose 32 is secured by means of a hose clamp 64. The metering device 60 includes a central bore 66 in a metering body 67, and terminates in a conventional orifice design, including orifice 68 which limits the flow rate of brine to the individual cells. A typical packing gland arrangement 69 is provided for fluid integrity of the metering device.

By appropriate selection of the orifice diameter, the level of brine within each hose 32 is selected to balance the head of liquid and gas in the respective anode compartment and cause a flow therefrom through the spent brine/chlorine hose 52. In this fashion, the height of feed brine within hose 32 will be lower than the vertical rise of the hose itself, thus maintaining an electrically insulative layer of air within the upper portion of the hose which will provide electrical isolation of the anode compartment. Feed water entering via header 36 is similarly metered, however, the need to provide electrical isolation is not essential as the water is substantially electrically non-conductive.

Figure 3:
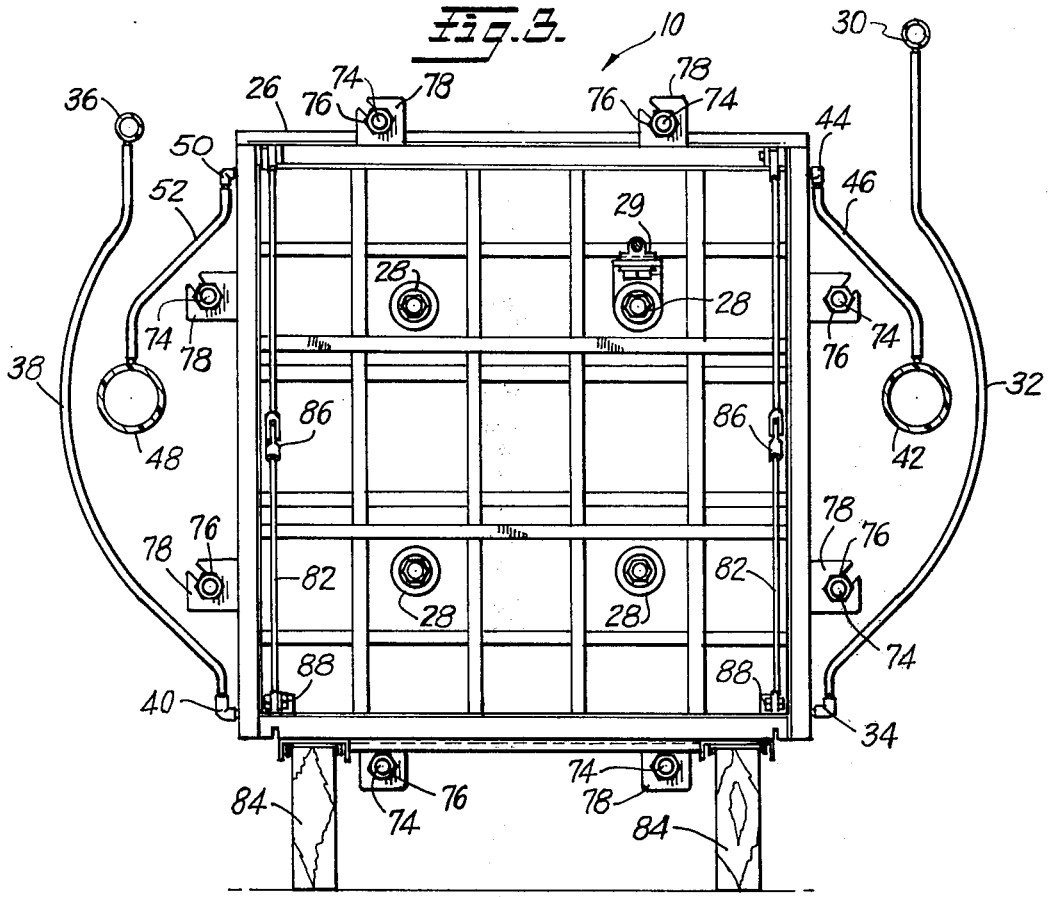
FIG. 3 is an enlarged end view of the electrolyzer, as viewed from the right of FIG. 1.
Figure 5:
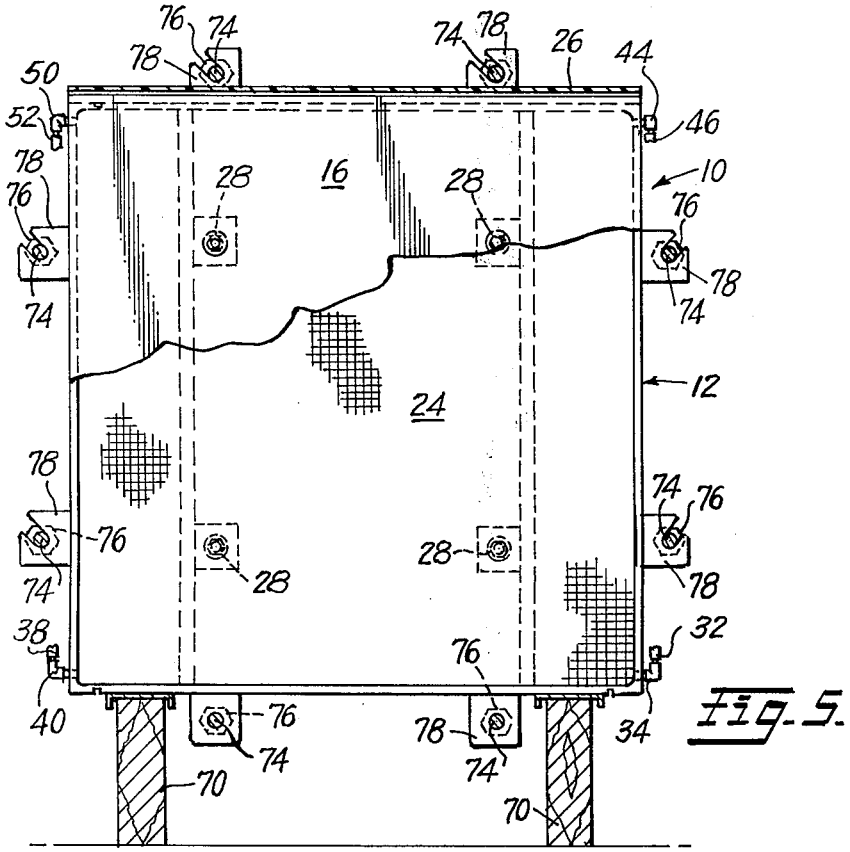

Internal fluid communication is achieved by taking advantage of the lower density of the liquid/gas mixture and that of the spent brine products, whereby the denser feed fluid urges the products of electrolysis upwardly within the cell compartments. To maximize reasonably uniform distribution of, most particularly, anolyte, it is preferable to provide the point of entry of the feed brine at a location diagonally opposite the point of exit of the spent brine/chlorine, as shown in FIG. 3.

Regardless, however, of the absolute configuration of the fluid paths, it is mandatory that individual paths be maintained with carefully controlled fluid integrity. Also, mechanical connections between adjacent cells must be scrupulously insured to prevent unwanted leakage. Obviously, the entire support structure for the electrolyzer must provide both positive retaining forces to appropriately seal and position the individual cells, and a reliable restraining force to insure the optimum vertical orientation of the cell structures. Otherwise, proper fluid flow of the various feeds and recovered products may be hampered or jeopardized.

To achieve these objectives, while eliminating much of the cumbersome and expensive structure of prior art devices, the electrolyzer support of the present invention is comprised, in its most essential aspects, of a longitudinally extending assembly for both supporting the electrolyzer cell and spacing it vertically from the floor, a tension bar assembly for providing a retaining or compressive force on the individual cells in order to assure optimum mechanical connection and fluid communication, and a terminal tie bar assembly for providing the requisite restraining force in order that the individual cells are maintained in the optimum, substantially vertical orientation.

The longitudinal support for electrolyzer 10 is provided by a pair of sleepers 70 which are disposed beneath the electrolyzer. The sleepers also provide appropriate spacing of the electrolyzer 10 from the floor. This arrangement eliminates the need for ears or hangers protruding from the sides of the cell frames while also eliminating the need for side rails upon which such ears or hangers rest. The sleeper assemblies 70 are shown to be fabricated from wood, however, the selection of any other material which possesses the necessary strength, rigidity, and chemical resistance in these environments, is well within the purview of the skilled artisan.

Figure 1:
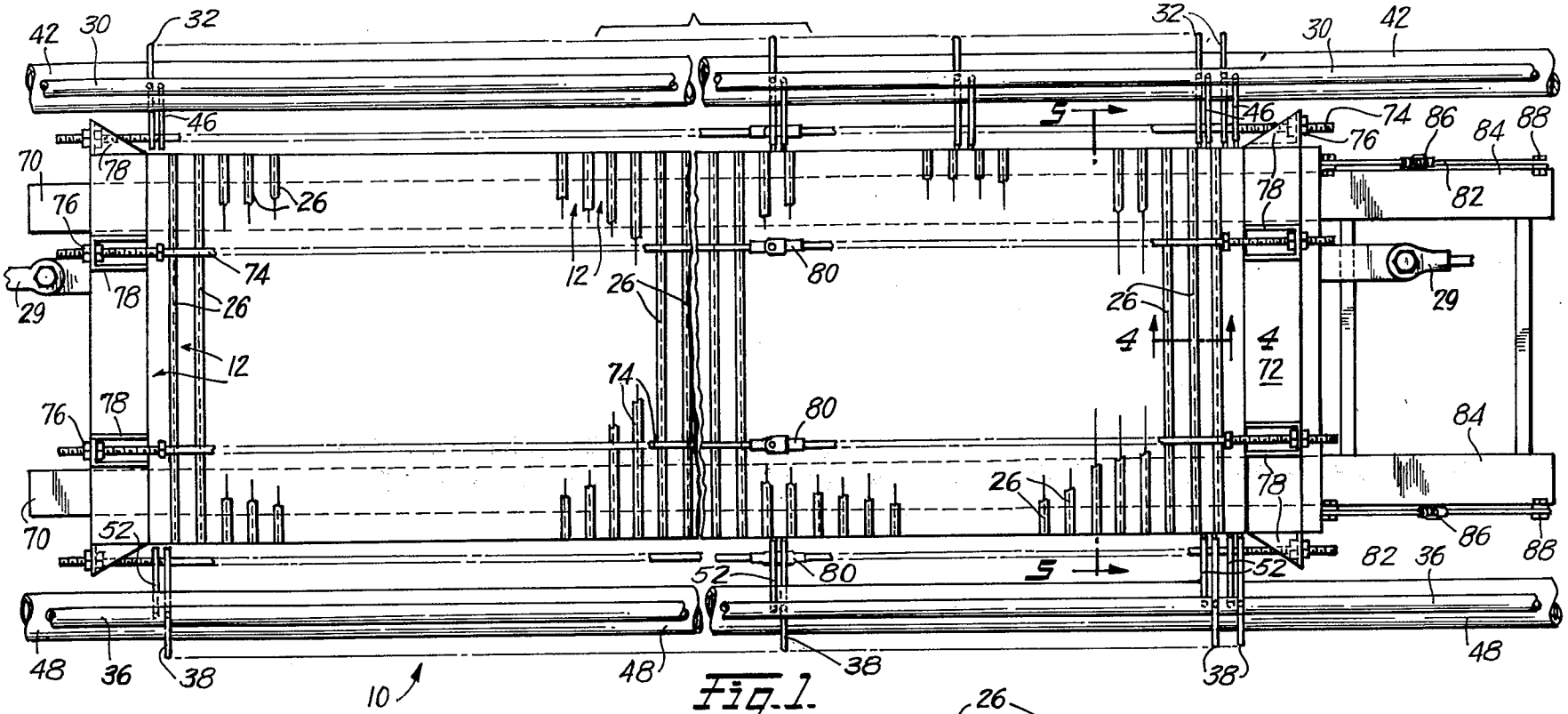
FIG. 1 is a fragmentary top plan view of the electrolyzer of the present invention.
Figure 2:
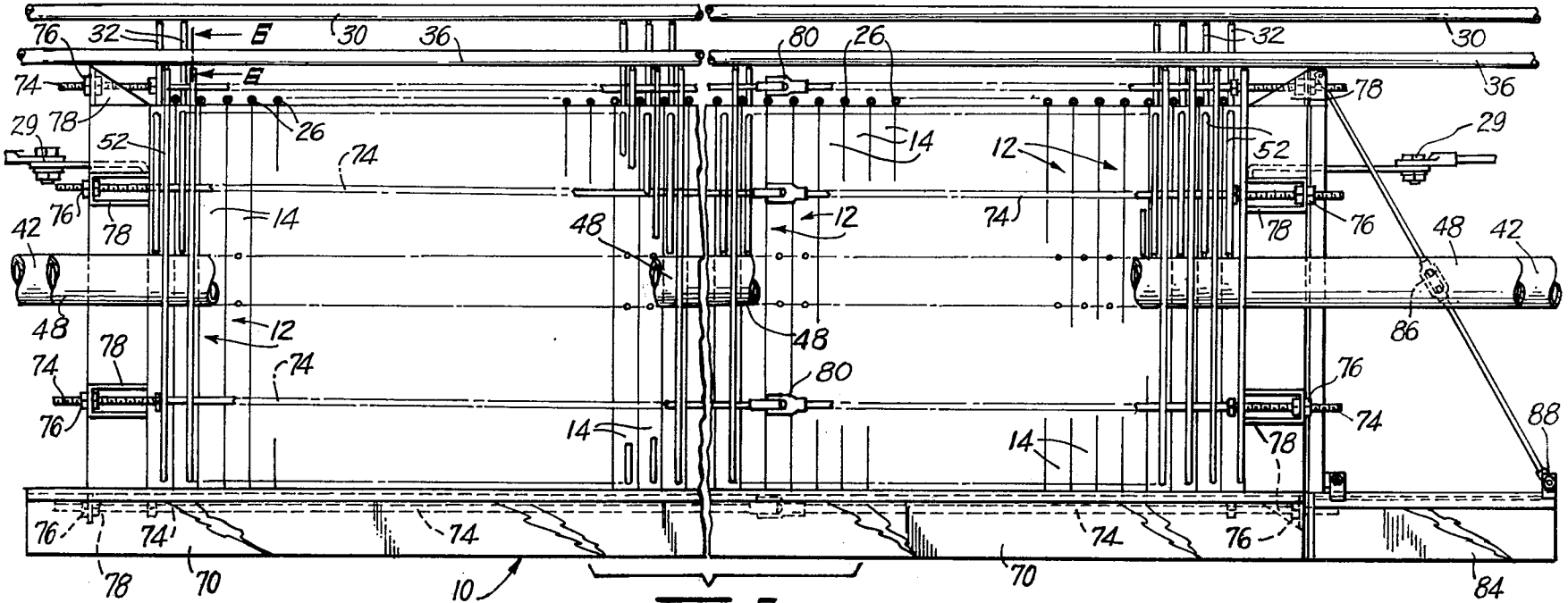
FIG. 2 is a fragmentary side elevation view of the electrolyzer of FIG. 1.
Figure 5:
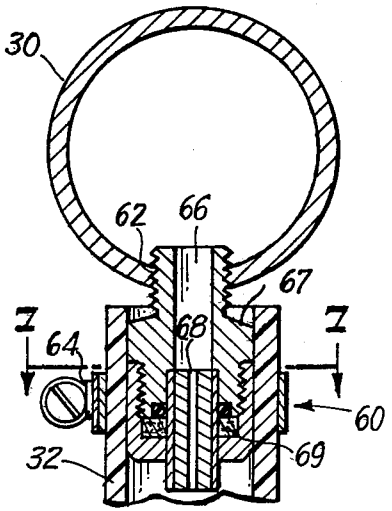
FIG. 5 is an enlarged transverse sectional view, taken substantially along the line 5—5 of FIG. 1, with the cell partitioning membrane broken away, showing the anode of the cell.
Figure 7:
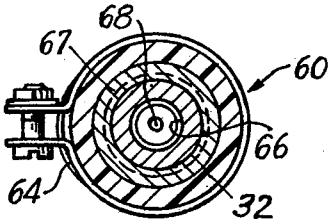

Because the side rails conventionally employed in electrolyzer cells are eliminated by virtue of the sleeper assemblies, other provisions must be made in order to insure appropriate orientation of the various cell members 12. The electrolyzer is, thus, provided with end frame members 72 at each end. The retaining or compressive force on the individual cells 12 is achieved by means of longitudinal tension bar assemblies 74 in concert with end frame members 72. The tension bar assemblies 74 are connected at opposing ends to each of the end frame panels 72 by means of fixture members 76, advantageously threaded nuts which mate with the threaded ends of the tension bars. For this purpose, hangers 78 are fastened to each of the end frames 72. For convenience, the tension bar assemblies 74 are comprised of a number of individual bars, as shown in FIGS. 1 and 2. Accordingly, union members 80 are employed to join the segmented bars 74 together. These union members might be a conventional universal to facilitate adjustment of the tension bars 74 at either end of the electrolyzer or, alternately, turnbuckle assemblies to augment the adjustability of the assemblies in order to provide an even greater range of adjustability. Regardless, however, of the absolute nature of the arrangement, the necessary retaining or compressive forces are simply achieved by tightening the tension bar nuts 76 against the hangers 78. Advantageously, it has been determined that eight such tension bars should be employed, two on each side of the electrolyzer. However, other configurations maybe selected by the skilled artisan, provided such other arrangements are capable of insuring the necessary retaining or compressive forces on the individual cells 12 such that good mechanical connection and fluid communication therebetween is maintained.

Appropriate vertical orientation of the individual cells comprising electrolyzer 10 is achieved by means of diagonal tie bars 82. Each diagonal tie bar assembly 82 is attached, at one end, to the top of one of the cell end frames 72, and at the other to an extension 84 of sleeper 70. However, the lower end of the tie bars 82 might be secured at any convenient anchor point horizontally displaced from the end frame 72. The magnitude of the restraining force applied by means of diagonal tie bars 82 is achieved, as with the longitudinal tension bars 74, by adjustment of, e.g., threaded nuts cooperating at either end with the tie bar itself. A universal or turnbuckle 86 is similarly provided to aid in adjustment of the magnitude of the restraining force so that the electrolyzer cells 12 are maintained in the necessary vertical orientation. The sense of this force is adjustable to the extent the lower fixture point 88 of tie bar 82 on the extension 84 may be moved inwardly or outwardly.

The design described above offers many advantages over the prior art structures heretofore employed. Expensive and cumbersome side rail supports and hydraulically or mechanically actuated platens which have been employed to compress the cell frames and members together are eliminated, as are the associated ears or hangers on the cell frames. All of the advantages offered by these more cumbersome and expensive devices are retained, however, inasmuch as the compressive or retaining forces on the cells may be adjustably provided by tension bar assemblies 74 in combination with end frames 72. Vertical stability is simply provided by means of diagonal tie bar assemblies 82.

Moreover, the simplicity of the present design allows for easy access to interior cells of the electrolyzer. For example, should it be required to remove an internal component, the longitudinal tension bars 74 may be loosened, and those bars on the top of the electrolyzer removed. The flexibility of the various feed and recovery hoses allows individual cells of the electrolyzer to be slightly displaced, and defective or worn out cells removed. The accomplishment of such removal of interior components is materially more difficult when prior art support structures are employed. See co-pending application, Ser. No. 866,156, filed Dec. 30, 1977, entitled METHOD AND APPARATUS FOR DISASSEMBLY OF A PLURAL CELL ELECTROLYZER, incorporated herein by reference and relied upon, for a more detailed description of the manner in which disassembly of an electrolyzer employing the support structure of the present invention is achieved.

While the invention has now been described in terms of certain preferred embodiments, the skilled artisan will readily appreciate that various substitutions, changes, omissions, and modifications may be made without departing from the spirit thereof. Accordingly, it is intended that the scope of the invention be limited solely by that of the following claims.

What is claimed is:

1. A retaining and restraining support structure for a plural cell electrolyzer, comprising:

(a) a sleeper assembly for supporting an electrolyzer cell vertically beneath the longitudinal dimension thereof;

(b) retaining support means for applying a longitudinal compressive force on the individual cells constituting said electrolyzer cell, comprising:

(i) terminal electrolyzer cell end frames;

(ii) a plurality of adjustable, longitudinal tension bars disposed between said end frames; and, (c) restraining support means for applying an oblique stabilizing force on said electrolyzer cell for maintaining the individual cells constituting the same in substantially vertical orientation, said restraining support means including adjustable, diagonal tie bar means extending from one of said end frames to a horizontally displaced anchor point.

2. The electrolyzer support of claim 1, wherein said diagonal tie bar means comprise a pair of adjustable tie bars.

3. The electrolyzer support of claim 2, wherein said anchor point lies on a horizontal extension of said sleeper assembly.

4. The electrolyzer support of claim 2, wherein each of said tension bars and said tie bars is comprised of plural bar members joined in end-to-end relationship by a union member.

5. The electrolyzer support of claim 3, wherein eight of said tension bars comprise said retaining support means, said tension bars disposed in sets of two on each of four sides of a substantially rectangular electrolyzer cell.

6. The electrolyzer support of claim 5, wherein said end frames include hanger members for fixation of said tension bars.

7. The electrolyzer support of claim 4, wherein said union member is a turnbuckle.

* * * * *